US006044620A

United States Patent [19]

Hernke et al.

[11] Patent Number: 6,044,620

[45] **Date of Patent: *Apr. 4, 2000**

[54] DRIVE-THROUGH STRAPPING MACHINE AND METHOD FOR SECURING A LOAD

[75] Inventors: Dale Norman Hernke, Dousman; Paul James Rick, Brownsville, both of Wis.

[73] Assignee: Quad/Tech, Inc., Sussex, Wis.

[ * ] Notice: This patent is subject to a terminal disclaimer.

[21] Appl. No.: 09/227,130

[22] Filed: Jan. 7, 1999

Related U.S. Application Data

[63] Continuation of application No. 08/916,973, Aug. 14, 1997, Pat. No. 5,921,069, which is a continuation of application No. 08/740,819, Nov. 4, 1996, Pat. No. 5,706,630, which is a continuation of application No. 08/521,089, Aug. 22, 1995, abandoned.

[51] Int. Cl.[7] ..... B65B 13/04

[52] U.S. Cl. ..... 53/399; 53/589; 100/26

[58] Field of Search ..... 53/399, 588, 589, 53/582, 592; 100/25, 26, 27

[56] References Cited

U.S. PATENT DOCUMENTS

| | | | |
|---|---|---|---|
| 2,664,813 | 1/1954 | Rose | 100/25 |
| 3,280,725 | 10/1966 | Bartram | 100/4 |
| 3,379,121 | 4/1968 | Lems | 100/2 |
| 4,079,565 | 3/1978 | Lancaster, III et al. . | |
| 4,228,733 | 10/1980 | Davis et al. | 100/4 |
| 4,282,700 | 8/1981 | Goldstein | 53/556 |
| 4,324,176 | 4/1982 | McCormick | 100/3 |
| 4,905,448 | 3/1990 | Plitt | 53/399 |

FOREIGN PATENT DOCUMENTS 890814 2/1982 Belgium .

*Primary Examiner*—Linda Johnson
*Attorney, Agent, or Firm*—Michael Best & Friedrich L.L.P.

[57] ABSTRACT

A drive-through strapping machine for use in securing materials together on a pallet and for securing stacked pallets together and a method for securing materials together for shipment or storage and for delivering those materials to a location. The drive-through strapping machine provides a strapping device for wrapping straps around a pallet or stacks of pallets while the pallets are supported on a forklift. The strapping machine also provides for movement of the forklift through the strapping machine for delivery of the pallets to a storage location or for shipment.

9 Claims, 4 Drawing Sheets

DRIVE-THROUGH STRAPPING MACHINE AND METHOD FOR SECURING A LOAD

RELATED APPLICATIONS

This is a continuation of Ser. No. 08/916,973 filed on Aug. 14, 1997 which issued as U.S. Pat. No. 5,921,069, which is a continuation of Ser. No. 08/740,819, filed Nov. 4, 1996 which issued as U.S. Pat. No. 5,706,630, which is a continuation of Ser. No. 08/521,089, filed Aug. 22, 1995, now abandoned.

FIELD OF THE INVENTION

The invention relates to methods and apparatus for strapping bundles on pallets and more particularly to strapping machines used in material handling applications and for wrapping a strap around the pallet and bundles supported on the pallet

BACKGROUND PRIOR ART

Shipment or storage of products supported on pallets commonly requires strapping of those products to the pallets to prevent shifting of the products during shipment. For example, when shipping pallets supporting printed material such as magazines or printed advertisements, straps are wrapped around the pallets to secure bundles of these printed products to the pallets. Additionally, two pallets are commonly conveyed in stacked relation. To prohibit shifting of the top pallet and the material on the pallet, straps are wrapped around both pallets to secure those pallets together.

In prior art processes for handling and shipping printed products such as magazines and printed advertisements, a pallet supporting bundles of magazines or other printed product is wrapped with a shrink wrap film. A second wrapped pallet is then placed on top of the first wrapped pallet. The stacked pallets are then placed on a roller conveyor of a strapping machine using a forklift, and the stacked pallets are conveyed on the roller conveyor through the strapping machine where straps are wrapped around both of the pallets to secure the pallets together and to prevent shifting of the materials supported by the pallets. Strapping machines of this type for use in wrapping straps around the strapped pallets are manufactured by EAM-Mosca Corporation, West Hazelton, Pennsylvania. The conveyor of the strapping machine then conveys the strapped pallets to a discharge area where a forklift is used to engage the strapped pallets and move them to a storage location or to a truck for shipping.

The strapping machines manufactured by EAX-Mosca include a strap feeding head which feeds an end of a strap into a channel. The channel surrounds the conveyor such that the end of the strap can be fed through the channel around the stacked pallets and back to the strap feeding head. The end of the strap is gripped by the strap feeding head and the strap feeding head will then retract the length of the strapping material while gripping the free end of the strap. The channels are provided with inwardly facing slots which permit the strap to be pulled out of the channels inwardly as the strap feeding head retracts the length of strap material and such that the strap is pulled snugly around the pallet supported on the conveyor. The strap feeding head further includes means for clamping or fixing two ends of the strap together and cutting off the remaining length of strap material.

In other prior art arrangements, stacked pallets are secured together by operators who manually wrap straps around the pallets and crimp the straps together. This manual process is time consuming because the straps can be difficult to handle and requires care by the operators to ensure that the pallets are securely strapped together.

U.S. Pat. No. 4,905,448 illustrates a machine for wrapping stretch wrap around a product supported on a pallet and includes a means for wrapping stretch wrap around a pallet supported by a forklift and wherein the forklift moves forwardly to a position where the pallet and material thereon are wrapped and wherein the forklift backs away from the wrapping machine once the shrink wrap is wound around the pallet and product.

U.S. Pat. No 4,079,565 illustrates a machine for wrapping stretch wrap around a pallet and product supported on the pallet and wherein a forklift can carry the pallet into the machine where the stretch wrap is wrapped around the pallet and material, and wherein the forklift then backs up out of the wrapping machine for delivery of the product.

U.S. Pat. No 4,282,700 illustrates a forklift carrying a stretch wrap machine which can wrap plastic film around the pallet and material on the pallet while the pallet is being carried by the forklift.

SUMMARY OF THE INVENTION

The invention includes a strapping machine for use in securing materials together on a pallet and for securing stacked pallets together and a method for securing materials together for shipment or storage and for delivering those materials to a location. More specifically the invention includes a strapping machine for use in wrapping a strap or straps securely around a pallet or stack of pallets while the pallet or stack of pallets are supported on a forklift or other material handling machine. The strapping machine also provides means for permitting the material handling vehicle to drive forwardly into a position where pallets are properly positioned for strapping and then forwardly through the strapping machine for delivery of the pallets to a storage location or to a truck.

The invention also includes a method for wrapping a strap securely around a pallet or stack of pallets while the pallet or pallets are supported by a forklift or other material handling vehicle, the method including the steps of positioning materials on the forklift, moving the forklift to a position where the materials and a portion of the forklift are positioned within an envelope of a strapping machine having means for wrapping at least one strap around the materials, wrapping at least one strap around the materials while the materials are supported on the forklift, and then moving the forklift and the materials supported by the forklift through the envelope of this strapping machine to a location for shipping.

One of the advantages of the invention is that the method and apparatus embodying the invention significantly reduce the time and effort to strap material handling pallets. The strapping machine permits a forklift operator to pick up a load, securely wrap strapping material around the load, and then move that strapped material to a storage location or a truck without requiring the forklift operator to position the pallets on a conveyor and without requiring the forklift operator to back up during the strapping and delivery process.

Another feature of the invention is the provision of sensors for determining the position of a pallet with respect to the strapping machine to ensure proper location of the pallet or stacked pallets in the envelope of the strapping machine.

Another feature of the invention is the provision of controls for the strapping machine in locations where they can be conveniently actuated by the forklift operator when the pallet or pallets are properly positioned in the envelope of the strapping machine.

Figure 1:
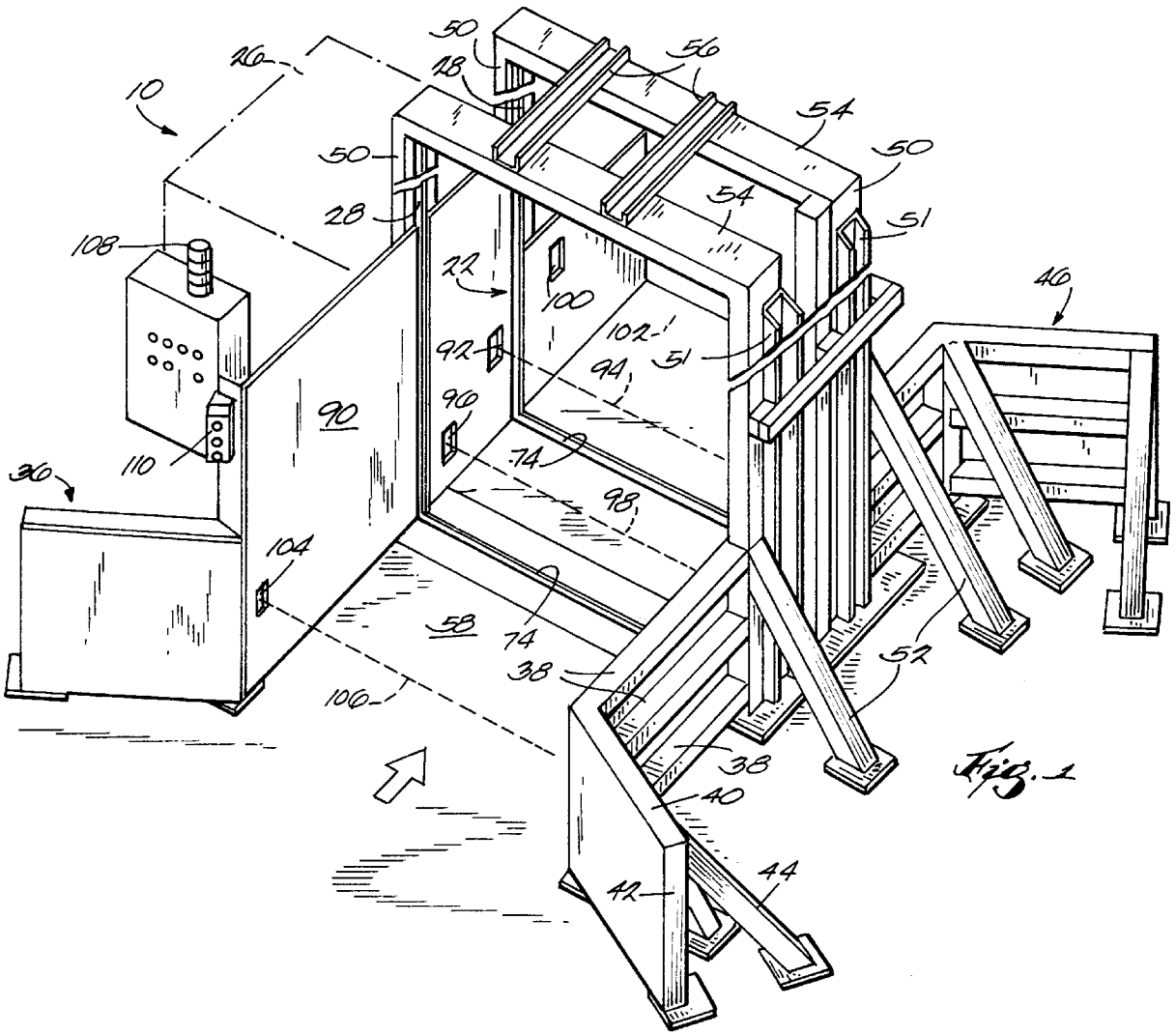
FIG. 1 is a perspective view of a drive-through strapping machine embodying the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology used herein is for the purpose of description and should not be regarded as limiting.

DESCRIPTION OF THE PREFERRED EMBODIMENT

Figure 2:
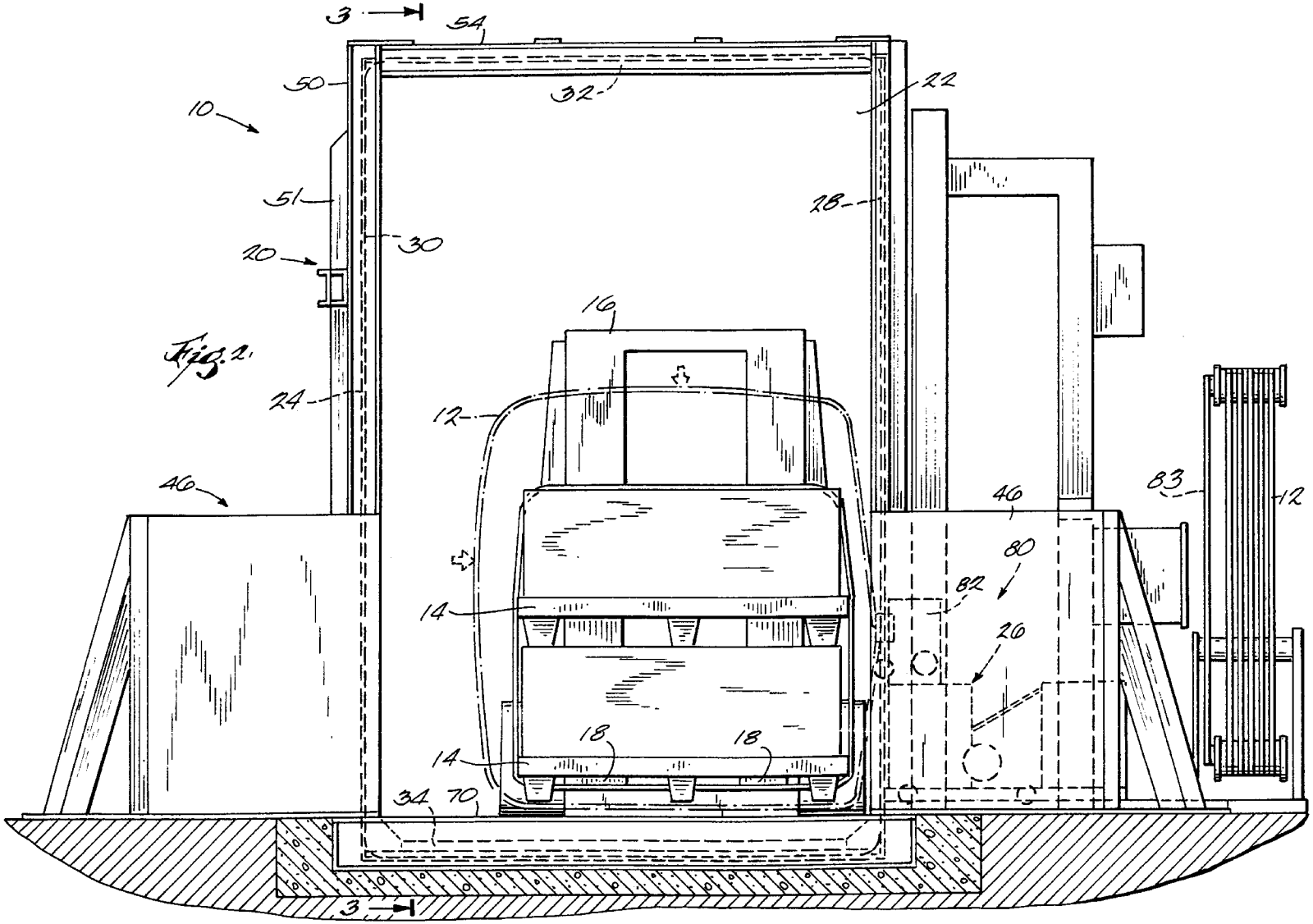
FIG. 2 is an end elevation view, partially in section, of the drive-through strapping machine shown in FIG. 1.

FIGS. 1 and 2 illustrate a drive-through strapping machine 10 embodying the invention and for use in wrapping a pair of straps 12 (FIG. 2) around load supporting pallets 14 supported on a material handling vehicle such as a forklift truck 16. The drive-through strapping machine 1C is constructed such that a forklift truck 16 supporting pallets 14 can be positioned in the strapping machine 10 whereby straps or banding 12 can be wrapped around the pallets 14 supported by the forklift 16 while those pallets are supported on the forks 18 of the forklift truck 16 and such that once the strapping operation is complete the forklift truck 16 can drive forwardly through the strapping machine 10 for delivery of the pallets.

Figure 3:
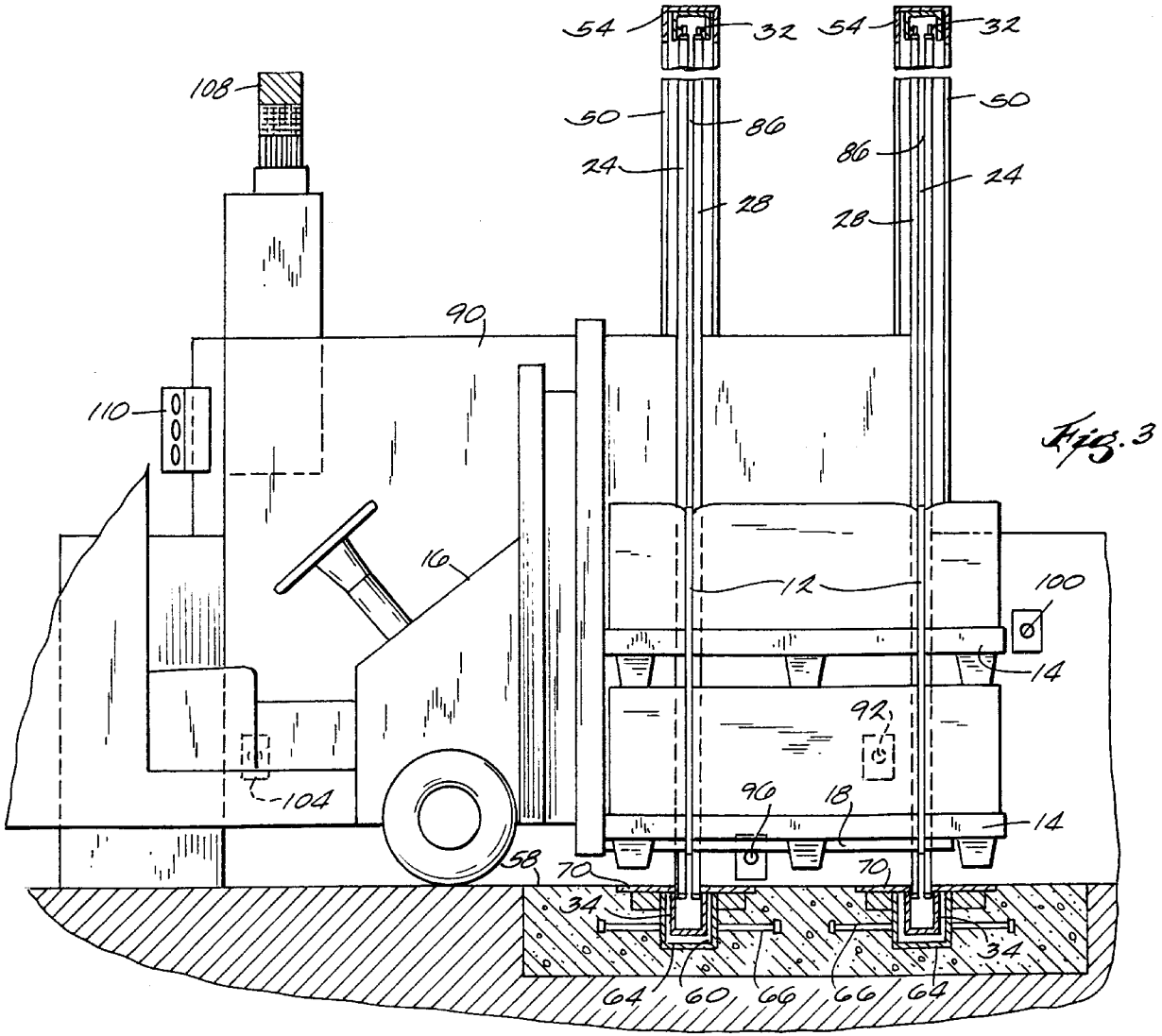
FIG. 3 is a cross-section view taken along line 3—3 of FIG. 2 and showing a forklift supporting stacked pallets in the envelope of the drive-through strapping machine.

The drive-through strapping machine 10 includes a frame assembly 20 defining a central opening or envelope 22 adapted to receive a load supported on the forks 18 of the forklift truck 16, and the envelope or central opening 22 is large enough to accommodate both the pallets 14 to be strapped as well as the forklift truck 16. The drive-through strapping machine 10 includes a pair of spaced apart channels or chutes 24 which extend around the central opening 22 and provide guide tracks for a pair of straps 12 fed through the channels 24 by a strap feeding machine or strapping unit 26. As best shown in FIG. 3, the channels 24 are spaced apart by a distance which will permit two straps 12 to be wrapped around the pallets 14. While in the illustrated construction two channels 24 are shown, in other configurations a single channel 24 could be provided if only a single strap 14 is to be wrapped around the pallets. In other arrangements more than two channels could be provided. The channels 24 each include a pair of spaced apart vertical channel portions 28 and 30 positioned on opposite sides of the opening and an upper horizontal channel portion 32 which bridges the upper ends of the vertical channel portions 28 and 30 and a lower channel portion 34 positioned below the surface of the floor 58 and extending between the lower ends of the vertical channel portions 28 and 30 to join the vertical channel portions. Each channel 24 provides a continuous guide track for a strap which can be fed through the channel so as to extend around the stacked pallets supported by a forklift 16 in the opening 22 defined by the channels.

A frame assembly 34 is also provided to function as structural support for the channels 24 and to provide a mechanism for protecting the channels 24 from damage by the forklift truck 16. More particularly, the frame assembly 34 includes an inlet fence arrangement 36 intended to guide a forklift truck into the strapping machine 10. The inlet fence arrangement 36 is comprised of welded steel structural members 38, 40, 42 and 44. The frame assembly also includes a similar discharge fence arrangement 46 provided to guide a forklift truck exiting from the strapping machine 10. The frame assembly 34 also includes a plurality of vertically extending beams or structural channels 51 and vertical structural beams 50 supported by angle beams 52 and horizontally extending structural beams 54 and 56. This frame structure is intended to provide support for the channels 24.

As best shown in FIGS. 2 and 3, the floor 58 supporting the strapping machine includes pits or recesses 60 housing the lower channel portions 34. Supporting beams 64 are also provided in the pits 60 to provide structural support and protection of the lower channel portions 34, and the supporting beams 64 are anchored in the floor 58 by anchor rods 66 embedded in the floor. The supporting beams 64 also support decking plates 70 which permit the forklift truck 16 to drive through the strapping machine. The decking plates 70 include slots 74 extending across the width of the strapping machine and permitting the straps 12 to be pulled upwardly out of the channels 34, as will be described, so as to engage load supporting pallets 14 supported on the forks 18 of the forklift truck 16.

Figure 4:
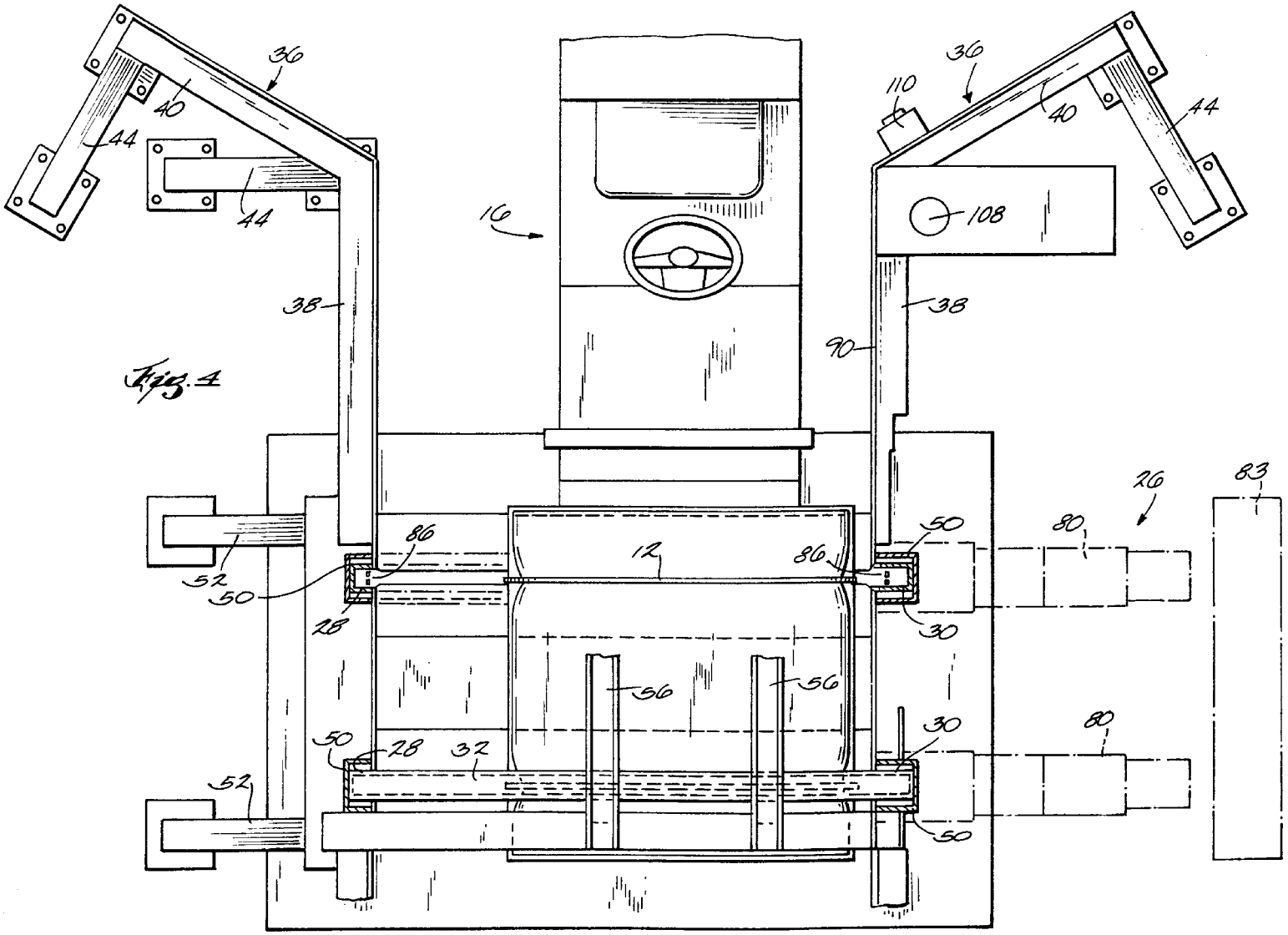
FIG. 4 is a plan view of the drive-through strapping machine and forklift illustrated in FIGS. 2 and 3.

The strapping machine also includes a strap feeding means 26 for feeding lengths of strap or banding 12 through the channels 24 and for tightening that strap 12 around pallets supported on a forklift truck 16. In one form of the invention the strap feeding means 26 can comprise two strap feeders 80 which can each comprise a CTS Series strap feeding machine manufactured by EAX-Mosca Corporation, West Hazelton, Pennsylvania. The construction and operation of each strap feeder 80 is conventional and is not illustrated or described in detail. Each strap feeder 80 includes a strap feeding head 82 which provides a means for feeding strap through the channels 24 and means for then pulling that strap tight around the pallet that means including a strap take up frame 83. That strap feeding head 82 feeds a free end of a strap comprised of a high strength plastic material through the channel 24 from a coil of strap. The free end of the strap is pushed through the channel in a counterclockwise direction as viewed in FIG. 2. The channel 24 functions to guide the free end of the strap 12 around the pallet and under the floor until the free end of the strap is once again engaged by the strap feeding head 82. The strap feeding head 82 includes means for gripping the free end of the strap 12 and means for then pulling back or retracting the length of strap material to pull it back through the strap feeding head 82 while the free end is held in place in the strap feeding head 82. As shown in FIGS. 3 and 4, the channels 24 which are provided to guide the straps 12 around the opening of the strapping machine include inwardly facing slots or openings 86 which permit the strap to be pulled inwardly out of the channels as shown in FIG. 2 once the strap feeding head 82 grips the free end of the strap 12 and retracts the strap. When the strap is retracted it extends under the forks 18 of the forklift truck and will tightly engage the loads support on the pallets 14. The strap feeding heads 82 also include means for joining or crimping two ends of the strap 12 together once the strap has been firmly pulled around the loaded stacked pallets. The strap feeding head 82 crimps or fixedly clamps the ends of the strap together and then shears off the strap from the supply of strap material.

In the illustrated construction the strap feeding machine also includes a side wall 90 intended to provide support and a guide to permit the forklift operator to position the stacked pallets 14 in close relation to the side of the strapping machine including the strap feeding heads 82. In a preferred form of the invention it is advantageous for the operator to position the pallet as close as possible to the strap feeding heads 82 so as to minimize the amount of slack in the straps following the strapping operation.

Means are also provided for producing a signal to the forklift operator when a pallet 14 is properly positioned in the envelope or opening 22 of the strapping machine and for providing a signal when the forklift and pallet are improperly positioned with respect to the strap feeding heads 82 and the channels 24 of the strapping machine. More specifically, this means for providing a position signal includes a plurality of position sensors best shown in FIGS. 1 and 3.

The position sensors include a first position sensor 92 which indicates when a pallet has been positioned in the opening or envelope of the strap feeding machine. This position sensor 92 can comprise an electric eye having a beam 94. As shown in FIG. 3, when a pallet 14 is positioned in the opening 22 of the strapping machine, the beam 94 from the first position sensor 92 will be interrupted. The position sensors also include a second position sensor 96 which senses when the pallet is in the correct vertical position. As shown in FIG. 3, this position sensor 96 can comprise an electric eye having a beam 98 which is uninterrupted as shown in FIG. 3 when the pallet is raised to the proper position for operation of the strapping machine.

A third position sensor 100 functions to produce a signal when a load end pallet has been moved too far forward through the envelope 22 of the strapping machine. This sensor 100 can also comprise an electric eye which will interrupt operation of the strapping machine if the beam 102 produced by the electric eye is interrupted.

A fourth sensor 104 is provided for indicating the position of a forklift truck 16 and indicates when the forklift truck 16 has moved too far forwardly into the strapping machine. In one form of the invention this indicator can also comprise an electric eye producing a beam 106 which is interrupted by proper positioning of the forklift truck.

In the illustrated construction a light assembly or "Christmas tree" 108 is provided to indicate to the operator proper positioning of the forklift truck and the pallets in the strapping machine. The light assembly can include a plurality of lights which will be illuminated when the electric eyes or other sensors indicate proper positioning of the pallet. When all of the lights are illuminated, the forklift operator will know that the forklift and pallets are properly positioned.

In the illustrated arrangement, a control panel 110 is also provided and is positioned within reach of the forklift operator when the operator is seated in the forklift 16. This control panel 110 will permit the operator to control operation of the strapping machine and strapping of the pallets once the forklift and pallets are properly positioned.

In operation of the strapping machine embodying the invention, the strapping machine provides a means for securing pallets together and for preventing shifting of materials on the pallets.

In operation of the strapping machine the forklift operator can pick up a pallet or stack of pallets on the forks of the forklift and drive forwardly into the envelope or opening of the strapping machine. When the forklift operator has properly positioned the pallets supported by the forklift in the strapping machine, the strapping machine can securely bind straps under the forks of the forklift truck and around the pallets while they are supported on the forks of the forklift truck. Following the strapping operation the operator can drive-through the envelope of the strapping machine to deliver the pallets to a storage location or to a truck for shipment. The operator can then lower the pallets until they rest on the floor and then slide the forks rearwardly out of the straps securing the pallets together.

Various features of the invention are set forth in the following claims.

What is claimed is:

1. A method for securing materials to a pallet comprising:

supporting a pallet with materials thereon on a manned material handling vehicle;

driving the vehicle in a first direction to a strapping machine;

selectively operating the strapping machine to secure the materials to the pallet, the selective operation being activated by the person on the vehicle; and driving the vehicle through the strapping machine in the first direction, wherein the vehicle is moved through the strapping machine in the first direction without having moved in a second direction.

2. The method of claim 1 wherein the strapping machine includes a guide wall and wherein said step of driving the vehicle to the strapping machine includes aligning the vehicle relative to the guide wall.

3. The method of claim 1 wherein the vehicle includes a forklift.

4. The method of claim 1 and further including the step of providing a control panel in operable communication with the strapping machine and wherein said operating step includes the person on the vehicle engaging the control panel to selectively operate the strapping machine.

5. The method of claim 1 further including the step of sensing whether the pallet is in a predetermined vertical position for strapping prior to the operating step.

6. A strapping machine assembly for securing materials to a pallet comprising:

a frame having an inlet and an outlet, the inlet and the outlet being in communication along a passageway, the passageway dimensioned to accommodate the movement of a material handling vehicle carrying an operator and carrying a pallet with materials thereon from the inlet to the outlet through the passageway;

a strapping device positioned between the inlet and the outlet and operable to secure the materials to the pallet while the vehicle is in the passageway; and a control panel adjacent the frame for controlling the operation of the strapping device, the control panel being positioned within reach of the operator of the vehicle while the vehicle is in the passageway and actuable by the operation of the strapping device.

7. The strapping machine assembly of claim 6 and further including a guide wall adapted to align the vehicle within the passageway.

8. The strapping machine assembly of claim 7 wherein the guide wall defines a portion of the inlet.

9. The strapping machine assembly of claim 6 and further including a vertical position sensor mounted on the strapping device, the sensor sensing the vertical position of the pallet relative to the passageway.

* * * * *

UNITED STATES PATENT AND TRADEMARK OFFICE

CERTIFICATE OF CORRECTION

PATENT NO : 6,044,620

DATED : April 4, 2000

INVENTOR(S) : Dale Norman Hernke, Paul James Rick

It is certified that error appears in the above-identified patent and that said Letters Patent is hereby corrected as shown below:

Column 3, line 32, delete "1C" and insert --10--.

Column 4, line 37, delete "EAX-Mosca" and insert --EAM-Mosca--.

Claim 6, column 6, line 52, after the third occurrence of "the" insert --operator to initiate--.

Signed and Sealed this

Twentieth Day of February, 2001

*Attest:*

Nicholas P. Godici

NICHOLAS P. GODICI

*Attesting Officer*

*Acting Director of the United States Patent and Trademark Office*